US005182980A

United States Patent [19]

Greer

[11] Patent Number: 5,182,980

[45] Date of Patent: Feb. 2, 1993

[54] HYDRAULIC CYLINDER POSITION SENSOR MOUNTING APPARATUS

[75] Inventor: Robert D. Greer, Peoria, Ill.

[73] Assignee: Caterpillar Inc., Peoria, Ill.

[21] Appl. No.: 831,709

[22] Filed: Feb. 5, 1992

[51] Int. Cl.[5] ..... F01B 25/26

[52] U.S. Cl. ..... 92/5.00 R; 91/DIG. 4; 200/82 E

[58] Field of Search ..... 92/5 R; 91/1, DIG. 4; 324/207.13, 207.17, 207.24, 644; 200/82 E, 82 R

[56] References Cited

U.S. PATENT DOCUMENTS

| | | | |
|---|---|---|---|
| 2,239,348 | 4/1941 | Wirtanen et al. | 92/5 R |
| 4,207,565 | 6/1980 | Isakson et al. | 92/5 R |
| 4,480,160 | 10/1984 | Stifeiman | 200/82 R |
| 4,632,018 | 12/1986 | Lymburner | 92/5 R |
| 4,726,282 | 2/1988 | LaBair | 92/5 R |
| 4,901,628 | 2/1990 | Krage | 91/1 |

*Primary Examiner*—Thomas E. Denion
*Attorney, Agent, or Firm*—John W. Grant

[57] ABSTRACT

Cylinder position sensor apparatuses are useful for monitoring the location of a piston within a hydraulic cylinder. The present position sensor mounting apparatus includes a resilient tubular electrical insulator positioned in a bore of a housing and has a leg of a sensor element extending therethrough. The sensor element is fixedly retained relative to the housing in one embodiment by a bolt which squeezes the insulator radially inwardly to clamp against the leg of the sensor element. In another embodiment, an insert slidably engages a tapered portion of a bore and is urged radially inwardly to squeeze the insulator inwardly to clamp against the sensor element. Thus, the insulator serves the dual purpose of electrically insulating the sensor element from the housing and the hydraulic cylinder while being utilized to clamp against the sensor element for retaining the sensor element within the housing.

15 Claims, 2 Drawing Sheets

HYDRAULIC CYLINDER POSITION SENSOR MOUNTING APPARATUS

DESCRIPTION

Technical Field

This invention relates generally to a hydraulic cylinder and more particularly to a mounting apparatus for mounting a position sensor within the hydraulic cylinder.

Background Art

Expansible chamber hydraulic cylinders are widely used in industrial and earthmoving type vehicles. The recent trend is to automatically control the extension and retraction of the hydraulic cylinders to achieve semi or totally automatic operating cycles. Some automatic controls rely on sensing the position of the pistons of the hydraulic cylinders for operation. One type of position sensor uses radio frequency (RF) signals within the actuating chamber of the hydraulic cylinder. The RF signals are transmitted from and received by a common antenna positioned within the hydraulic cylinder. One of the problems encountered therewith is how to effectively mount the antenna within the actuating chamber at a fixed position relative to the internal surfaces of the hydraulic cylinder while electrically insulating the antenna from the metal structure of the cylinder. This problem is compounded in that an external electrical lead must be connected to the antenna. Moreover, the device for mounting the antenna must be capable of withstanding the high hydraulic pressure associated with operation of the hydraulic cylinders as well as the harsh environmental conditions to which the hydraulic cylinders are exposed.

Thus it would be desirable to have position sensor mounting apparatus that effectively mounts an antenna within an actuating chamber of a hydraulic cylinder at a fixed position relative to the internal surfaces of the hydraulic cylinder while electrically insulating the antenna from the metal structure of the cylinder. The mounting apparatus should also be capable of withstanding the high hydraulic pressure associated with operation of the hydraulic cylinders as well as the harsh environmental conditions to which the hydraulic cylinders are exposed.

The present invention is directed to overcoming one or more of the problems as set forth above.

DISCLOSURE OF THE INVENTION

In one aspect of the present invention, a position sensor mounting apparatus is provided for positioning a sensor element within an actuating chamber of a hydraulic cylinder. The mounting apparatus includes a bore in the hydraulic cylinder opening into the actuating chamber. A cylindrical housing is positioned in the bore and has an axially extending bore opening into an actuating chamber. A means is provided for fastening the housing to the cylinder. A resilient tubular insulator is disposed in the housing bore with the sensor element extending therethrough. A means is provided for retaining the insulators within the bore while another means is provided for squeezing the insulator radially inwardly so that a clamping force is exerted on the sensor element.

BEST MODE FOR CARRYING OUT THE INVENTION

Figure 2:
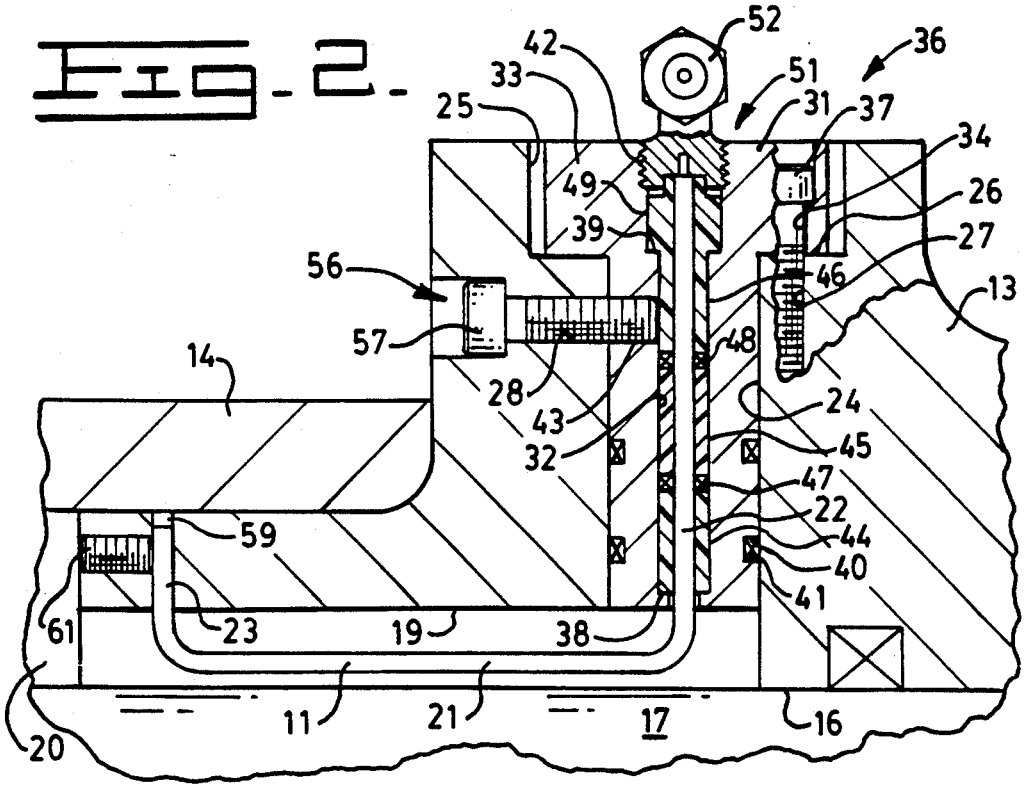
FIG. 2 is an enlarged sectional view of a portion of the embodiment of FIG. 1.

A position sensor mounting apparatus 10 is provided for mounting a sensor element 11 within a hydraulic cylinder 12. The hydraulic cylinder 12 has a head 13 suitably connected to a tubular cylinder 14 and having a piston rod receiving bore 16 therein. A piston rod 17 slidably extends through the bore 16 and has a piston 18 attached thereto with the piston being slidably disposed within the cylinder 14 in the usual manner. The head 13 has an annular recess 19 therein concentric with the bore 16. The recess forms part of an actuating chamber 20 adapted to contain hydraulic fluid for actuating the hydraulic cylinder in the usual manner. The sensor element 11 in this embodiment is an antenna for transmitting and receiving radio frequency signals. As best shown in FIG. 2, the antenna has a main portion 21 and a long leg 22 and a short leg 23 extending therefrom. The main portion 21 is positioned parallel to and in close proximity to the piston rod 17.

The mounting device 10 includes a bore 24 in the head 13 of the hydraulic cylinder 12 substantially perpendicular to the bore 16 and opening into the recess 19. The head 13 also includes a counterbore 25 concentric with the bore 24 and which terminates at an annular shoulder 26. A plurality of threaded holes, one shown at 27, extend inwardly from the annular shoulder 26. The head has a threaded hole 28 therein perpendicular to and opening into the bore 24.

A cylindrical housing 31 is positioned in the bore 24 and has an axially extending bore 32 opening into the recess 19. The cylindrical housing has a flange 33 positioned within the counterbore 25 and seated on the annular shoulder 26. A plurality of holes, one shown at 34, extend through the flange 33 and are axially aligned with the threaded holes 27. A means 36 is provided for fastening the cylindrical housing to the head 13 of the hydraulic cylinder 12. The fastening means 36 can be, for example, a plurality of cap screws, one shown at 37, extending through the holes 34 in the flange 33 and threaded into the threaded holes 27. The bore 32 is a stepped bore defining a pair of axially spaced annular shoulders 38,39 and has a threaded portion 42. A radially extending hole 43 in the housing 31 is in alignment with the threaded hole 28 in the head 13. A pair of annular grooves 40 are formed in the housing 31 with each of the grooves 40 having an annular seal 41 seated therein sealingly contacting the bore 24.

A plurality of resilient tubular insulators 44,45,46 are disposed in the housing bore 32 in end-to-end relationship with the long leg 22 of the sensor element 11 extending therethrough. A pair of seals 47,48 are disposed between adjacent ones of the insulators 44,45,46 and are in sealing engagement with the long leg 22. The insulator 44 is seated on the annular shoulder 38. The insulator 46 has an enlarged portion 49 seated against the annular shoulder 39. The insulators are preferably made from an electrically non-conductive material, such as plastic or the like, having sufficient rigidity in the axial direction to withstand the hydraulic forces exerted thereon while having the capability of being squeezed radially inwardly when a mechanical force is applied. thereto.

A means 51 is provided for retaining the insulators 44,45,46 within the bore 32. The means 51 can include, for example, the shoulders 38,39 and a coaxial cable fitting 52 threaded into the threaded portion 42. The fitting 52 contacts the enlarged portion 49 of the insulator 46 and is suitably electrically connected to the leg 22 of the sensor element 11.

A means 56 is provided for squeezing the insulator 46 radially inwardly so that a clamping force is exerted on the leg 22. The squeezing means 56 can be, for example, a bolt 57 threaded into the threaded hole 28 of the head 13 and through the hole 43 in the cylindrical housing 31 and squeezably engaging the insulator 46.

The short leg 23 of the sensor element 11 extends into a hole 59 in the head 13 and is retained therein by a set screw 61.

Figure 3:
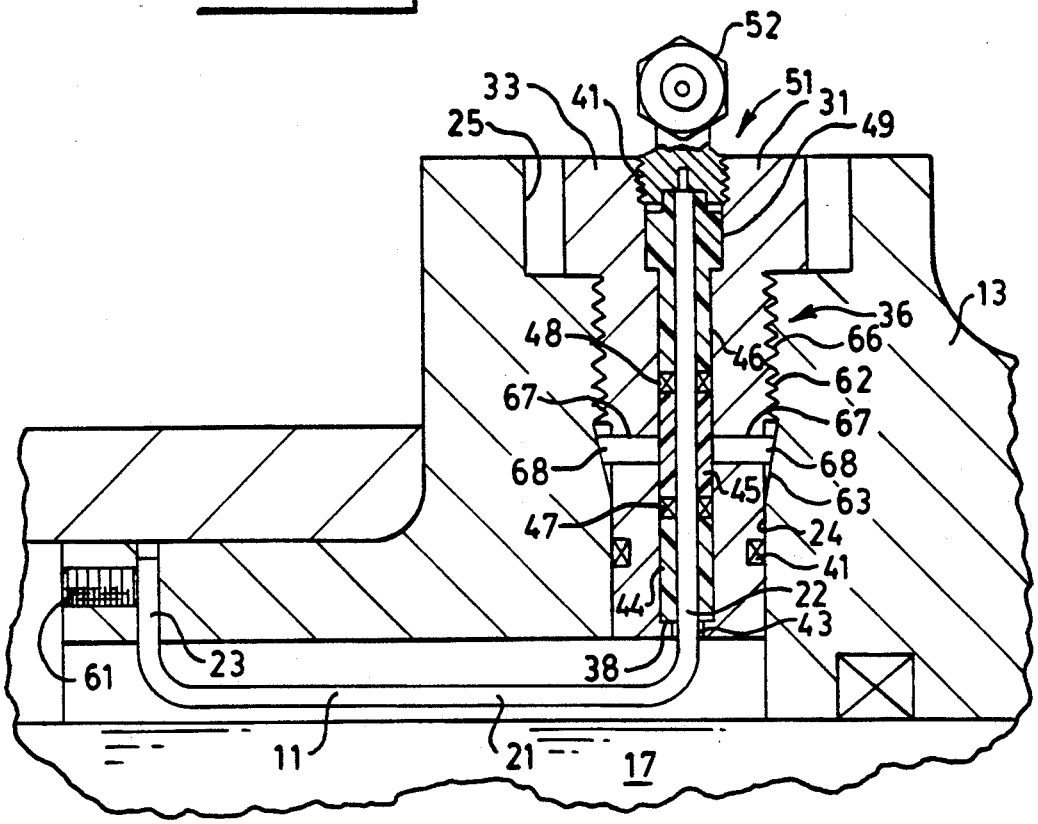
FIG. 3 is a sectional view similar to FIG. 2 of another embodiment of the present invention.

An alternate embodiment of a position sensor mounting apparatus 10 of the present invention is disclosed in FIG. 3. It is noted that the same reference numerals of the first embodiment are used to designate similarly constructed counterpart elements of this embodiment. In this embodiment, however, the bore 24 in the head 13 has a threaded portion 62 and a tapered portion 63. The cylindrical housing 31 has a threaded section 66 screw threaded into the threaded portion 62 of the bore 24. Thus the fastening means 36 in this embodiment includes the threaded portion 62 and the threaded section 66. The housing 31 also includes a pair of radially extending axially aligned passages 67 adjacent the tapered portion 63. A pair of locking inserts 68 are individually disposed within the passages 67 with their inner ends in contact with the insulator 45. Thus the squeezing means 56 in this embodiment includes the tapered portion 63, the passages 67, and the inserts 68. The flange 33 in this embodiment has a hexagonal shape adapted to receive a suitable tool for rotating the housing.

INDUSTRIAL APPLICABILITY

Figure 1:
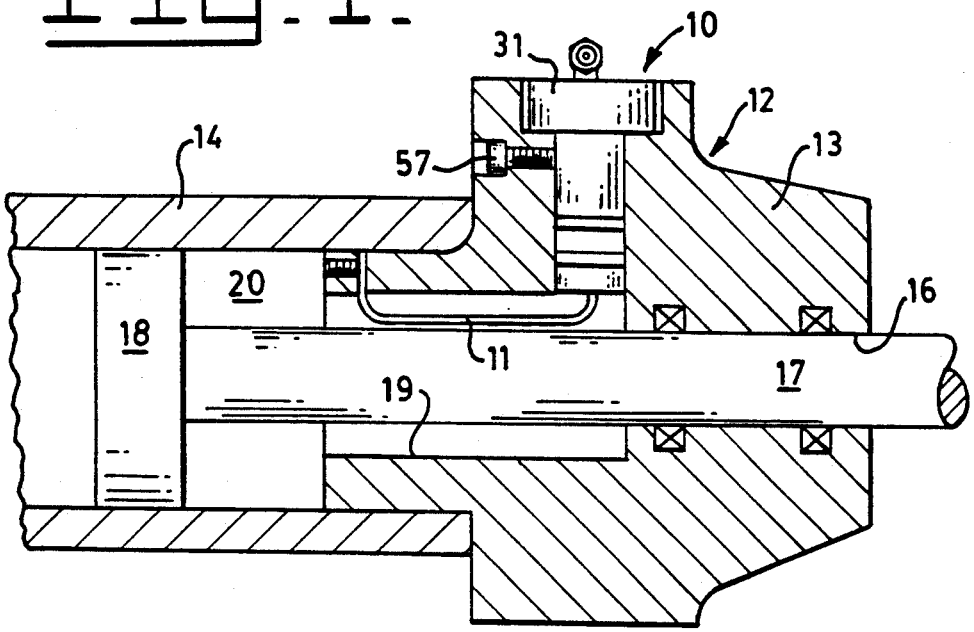
FIG. 1 is a sectional view of an embodiment of the present position sensor mounting apparatus.

In the use of the embodiment of FIG. 1, the tubular insulators 44,45,46 and the seals 47,48 are preassembled within the bore 32 of the cylindrical housing 31 and the cable fitting 52 threaded into the threaded portion 42 of the bore 32. The housing 31 is then inserted into the bore 24 of the cylinder head 13 with the leg 22 of the sensor element 11 being inserted through the insulators and electrically engages the cable fitting 52. The housing 31 is then fastened to the head with the cap screws 37. The antenna 11 is then precisely positioned at its desired location and the bolt 57 threaded through the threaded hole 28 sufficiently to squeeze the insulator 46 against the sensor element 11. At the desired location, the leg 23 of the sensor element extends into the hole 59 and is secured with the set screw 61. The frictional contact between the leg 22 and the seals 47,48 is sufficient to maintain the antenna at the desired location while the bolt 57 is being tightened.

In the use of the FIG. 3 embodiment, the insulators 44,45,46, the seals 47,48, and the cable fitting 52 are preassembled within the housing 31 as essentially described above. The locking inserts 68 are then inserted into the passages 67 and the assembled components inserted into the bore 24 of the cylinder head 13 with the threaded section 66 threadably engaging the threaded portion 62. The leg 22 of the sensor element 11 is inserted through the tubular insulators 44,45,46 while the other leg is seated in the hole 59. The housing 31 advances radially inwardly by the action of the threaded section 66 and the threaded portion 62. Prior to the housing 31 reaching its final position, the inserts 68 contact the tapered portion 63 causing the inserts to be forced radially inwardly to squeeze the insulator 45 inwardly to clamp against the leg 22 of the sensor element 11 to firmly lock it into its desired position. The leg 23 of the sensor element 11 is locked in the hole 59 with the set screw 61.

In view of the foregoing, it is readily apparent that the structure of the present invention provides an improved position sensor mounting apparatus for mounting a position sensor in the form of an RF antenna within a hydraulic cylinder with the antenna being electrically isolated from the housing and the cylinder head. This is accomplished by utilizing the resiliency of the insulators by squeezing one of the insulators inwardly against the antenna for holding the antenna at its desired location. Thus, the antenna remains free of metallic contact with the housing and/or head, except at the set screw 61 which acts to suitably ground the antenna to the head.

Other aspects, objects, and advantages of this invention can be obtained from a study of the drawings, the disclosure, and the appended claims.

I claim:

1. A position sensor mounting apparatus for positioning a sensor element within an actuating chamber of a hydraulic cylinder comprising:

means defining a bore in the hydraulic cylinder opening into the actuating chamber;

a cylindrical housing positioned in the bore and having an axially extending bore opening into the actuating chamber;

means for fastening the cylindrical housing to the hydraulic cylinder;

a resilient tubular insulator disposed in the housing bore with the sensor element extending therethrough;

means for retaining the insulator within the cylindrical housing; and means for squeezing the insulator radially inwardly so that a clamping force is exerted on the sensor element.

2. The mounting apparatus of claim 1 including a second tubular insulator disposed in the housing bore, and a seal disposed between the insulators and sealingly contacting the sensor element.

3. The mounting device of claim 1 including a plurality of tubular insulators disposed in the housing bore in end-to-end relationship and a fluid seal disposed between adjacent pair of insulators and sealingly contacting the sensor element.

4. The mounting device of claim 3 wherein the housing bore is a stepped bore defining an annular shoulder adjacent the actuating chamber, one of the insulators being seated against the annular shoulder.

5. The mounting device of claim 4 wherein the retaining means includes a threaded portion in the housing bore and a coaxial cable fitting threadably positioned in the threaded portion in contact with another one of the insulators and in electrical contact with the sensor element.

6. The mounting device of claim 4 wherein the stepped bore in the housing defines another annular shoulder adjacent the cable fitting, and another one of the insulators has an enlarged diameter portion seated on the second annular shoulder.

7. The mounting device of claim 6 wherein the retaining means includes a threaded portion in the housing bore and a coaxial cable fitting threadably positioned in the threaded portion in contact with the another one of the insulators and in electrical contact with the sensor element.

8. The mounting device of claim 3 wherein the cylindrical housing has a radially outwardly extending flange seated against the hydraulic cylinder and having a plurality of holes therethrough, and the fastening means includes a plurality of threaded holes in the hydraulic cylinder and a plurality of cap screws extending through the holes in the flange and threadably engaging the threaded holes.

9. The mounting apparatus of claim 8 wherein the squeezing means includes a threaded hole in the hydraulic cylinder perpendicular to the bore in the hydraulic cylinder, a hole in the cylindrical housing in alignment with the threaded hole and opening into the housing bore, and a bolt threaded into the threaded passage and squeezably engaging one of the insulators.

10. The mounting device of claim 9 wherein the housing bore is a stepped bore defining an annular shoulder adjacent the actuating chamber, one of the insulators being seated against the annular shoulder.

11. The mounting device of claim 10 wherein the retaining means includes a threaded portion in the housing bore and a coaxial cable fitting threadably positioned in the threaded portion in contact with another one of the insulators and in electrical contact with the sensor element.

12. The mounting device of claim 3 wherein the fastening means includes a threaded portion in the bore of the hydraulic cylinder and a threaded section on the cylindrical housing threadably engaging the threaded portion.

13. The mounting device of claim 12 wherein the squeezing means includes a tapered portion in the bore of the hydraulic cylinder, a radially extending passage in the cylindrical housing and opening into the housing bore, and an insert disposed in the radial passage and slidably engaging the tapered portion and squeezably engaging one of the insulators.

14. The mounting device of claim 13 wherein the housing bore is a stepped bore defining an annular shoulder adjacent the actuating chamber, one of the insulators being seated against the annular shoulder.

15. The mounting device of claim 14 wherein the retaining means includes a threaded portion in the housing bore and a coaxial cable fitting threadably positioned in the threaded portion in contact with another one of the insulators and in electrical contact with the sensor element.

* * * * *